US008262861B2

(12) United States Patent
Johansson

(10) Patent No.: US 8,262,861 B2
(45) Date of Patent: Sep. 11, 2012

(54) REFINER FOR REFINING PULP

(75) Inventor: Ola M. Johansson, Brookfield, WI (US)

(73) Assignee: J & L Fiber Services, Inc., Waukesha, WI (US)

( * ) Notice: Subject to any disclaimer, the term of this patent is extended or adjusted under 35 U.S.C. 154(b) by 234 days.

(21) Appl. No.: 12/041,379

(22) Filed: Mar. 3, 2008

(65) Prior Publication Data

US 2008/0149291 A1 Jun. 26, 2008

Related U.S. Application Data

(62) Division of application No. 11/068,490, filed on Feb. 28, 2005, now Pat. No. 7,347,392.

(51) Int. Cl.
*D21B 1/32* (2006.01)

(52) U.S. Cl. ..... 162/261

(58) Field of Classification Search ..... 162/261; 241/28, 245, 246, 261.2, 261.3, 297, 298
See application file for complete search history.

(56) References Cited

U.S. PATENT DOCUMENTS

| | | | |
|---|---|---|---|
| 4,039,154 | A | 8/1977 | Peterson |
| 4,083,503 | A | 4/1978 | Langdon |
| 4,129,263 | A | 12/1978 | Sjobom |
| 4,221,631 | A | 9/1980 | Hellerqvist et al. |
| 4,401,280 | A | 8/1983 | Reinhall |
| 4,676,440 | A | 6/1987 | Perkola |
| 4,783,014 | A | 11/1988 | Fredriksson et al. |
| 5,165,592 | A | 11/1992 | Wasikowski |
| 5,248,099 | A | 9/1993 | Lahner et al. |
| 5,335,865 | A | 8/1994 | Kohler et al. |
| 5,373,995 | A | 12/1994 | Johannson |
| 5,425,508 | A | 6/1995 | Chaney |
| 5,492,548 | A | 2/1996 | Wasikowski |
| 5,695,136 | A | 12/1997 | Rohden et al. |
| 5,823,453 | A | 10/1998 | Garasimowicz |
| 5,824,265 | A | 10/1998 | Dodd |
| 5,863,000 | A | 1/1999 | Gingras |
| 5,868,330 | A | 2/1999 | Dodd et al. |
| 5,875,982 | A | 3/1999 | Underberg |
| 5,934,585 | A | 8/1999 | Chaney |
| 5,988,538 | A | 11/1999 | Bartels |
| 7,347,392 | B2 | 3/2008 | Johansson |
| 2009/0302140 | A1 | 12/2009 | Johansson |

FOREIGN PATENT DOCUMENTS

| | | | |
|---|---|---|---|
| EP | 0877117 | A2 | 11/1998 |
| GB | 2083375 | | 3/1982 |
| SE | 530931 | C2 | 8/2006 |
| WO | WO9600616 | A1 | 1/1996 |
| WO | WO0006302 | A1 | 2/2000 |

OTHER PUBLICATIONS

Office Action Summary and Detailed Action, U.S. Appl. No. 11/068,490 / Patent No. 7,347,392, Dec. 5, 2006.
Response to Dec. 5, 2006, Office Action, U.S. Appl. No. 11/068,490 / Patent No. 7,347,392, Apr. 5, 2007.

(Continued)

*Primary Examiner* — Mark Halpern
(74) *Attorney, Agent, or Firm* — Quarles & Brady LLP

(57) ABSTRACT

A refiner plate for forming accepts and exhaust from a pulp material includes a first side and a second side and defines a channel extending between the first side and the second side. The channel is operable to direct at least some of the exhaust and at least some of the accepts away from the first side.

23 Claims, 4 Drawing Sheets

OTHER PUBLICATIONS

Office Action Summary and Detailed Action, U.S. Appl. No. 11/068,490 / Patent No. 7,347,392, May 8, 2007.
Response to May 8, 2007, Office Action, U.S. Appl. No. 11/068,490 / Patent No. 7,347,392, Sep. 10, 2007.
Extended European Search Report, PCT/US2006006001881, EP06718887, Sep. 22, 2008.
Supplementary European Search Report, PCT/US2006001881, EP06718887, Oct. 9, 2008.
European Patent Office Communication, EP06718887, Feb. 25, 2009.
Response to Feb. 25, 2009, Office Communication, EP06718887, Sep. 7, 2009.
Intellectual Property Office of New Zealand Examination Report, Patent Application No. 560984, Jul. 9, 2009.
IP Australia Examiner's First Report, Patent Application No. 2006219030, Apr. 21, 2010.
Response to Apr. 21, 2010, IP Australia Examiner's First Report, Patent Application No. 2006219030, Aug. 19, 2010.
PCT International Search Report and Written Opinion, PCT/US2006/001881, Mar. 7, 2007.
PCT International Preliminary Report on Patentability, PCT/US2006/001881, Sep. 20, 2007.
Swedish Patent Office Communication, Patent Application No. 0600397-4, Jan. 19, 2007.
Swedish Patent Office Final Office Action, Patent Application No. 0600397-4, Jun. 11, 2008.
Office Action Summary and Detailed Action, U.S. Appl. No. 12/488,268, Sep. 24, 2010.
PCT International Search Report and Written Opinion, PCT/US2009/048002, Aug. 9, 2010.
Response to Intellectual Property Office of New Zealand Examination Report of Jul. 9, 2009, Patent Application No. 560984, Nov. 2, 2010.

REFINER FOR REFINING PULP

CROSS-REFERENCE TO RELATED APPLICATION

This application is a divisional of U.S. patent application Ser. No. 11/068,490, filed Feb. 28, 2005, now U.S. Pat. No. 7,347,392.

STATEMENT OF FEDERALLY SPONSORED RESEARCH OR DEVELOPMENT

Not applicable.

FIELD OF THE INVENTION

The present invention relates to rotary refiners and methods of refining and, more particularly, to a refiner plate and to methods of refining pulp with the refiner plate.

BACKGROUND

A rotary refiner generally grinds pulp material, such as, for example, wood chips and clumps of larger fibers, into smaller fibers for use in the production of paper and paper-related products. In many cases, rotary refiners include two or more refining plates having opposable grinding surfaces. Typically, pulp is directed between the grinding surfaces of the refining plates and at least one of the refining plates is rotated relative to the other plate to grind the pulp between the rotary plates. This grinding action can also generate heat and exhaust vapor.

SUMMARY

Some embodiments of the present invention provide a refiner plate for forming accepts and exhaust from a pulp material. In some embodiments, the refiner plate includes a first side, a second side, and a channel extending between the first side and the second side, the channel being operable to direct at least some of the exhaust and at least some of the accepts away from the first side.

In addition, some embodiments of the invention provide a method of refining a pulp material using a refiner plate having a first side and a second side and defining a channel extending between the first side and the second side. Some embodiments include the acts of directing the pulp material across the first side of the refiner plate to form exhaust and accepts from the pulp material, and directing at least some of the exhaust and at least some of the accepts outwardly through the channel toward the second side.

Some embodiments of the invention provide a refiner plate for forming accepts and exhaust from a pulp material. In some embodiments, the refiner plate includes a first side and a second side spaced a distance from the first side, and a channel extending through the refiner plate and communicating between the first side and atmosphere for directing at least some of the exhaust and at least some of the accepts away from the first side.

In addition, some embodiments of the invention provide a method of refining a pulp material using a refiner plate including a first side having an outer edge, a second side spaced a distance from the first side, and a channel communicating between the first side and atmosphere. Some embodiments include the acts of directing the pulp material across the first side of the refiner plate to form accepts and exhaust from the pulp material, directing at least some of the exhaust outwardly through the channel and away from the refining plate, and directing at least some of the accepts across the outer edge of the first side.

Some embodiments of the invention provide a method of refining a pulp material using a refiner plate including a first side having an inner edge and an outer edge, a second side spaced a distance from the first side, and a channel communicating between the first side and atmosphere. Some embodiments include the acts of directing the pulp material across the first side of the refiner plate toward the outer edge to form accepts and exhaust from the pulp material and directing at least some of the exhaust outwardly through the channel to substantially prevent at least one of the pulp material, the accepts, and the exhaust from traveling across the first side of the refiner plate toward the inner edge.

Further aspects of the present invention, together with the organization and operation thereof, will become apparent from the following detailed description of the invention when taken in conjunction with the accompanying drawings, wherein like elements have like numerals throughout the drawings.

Figure 1:
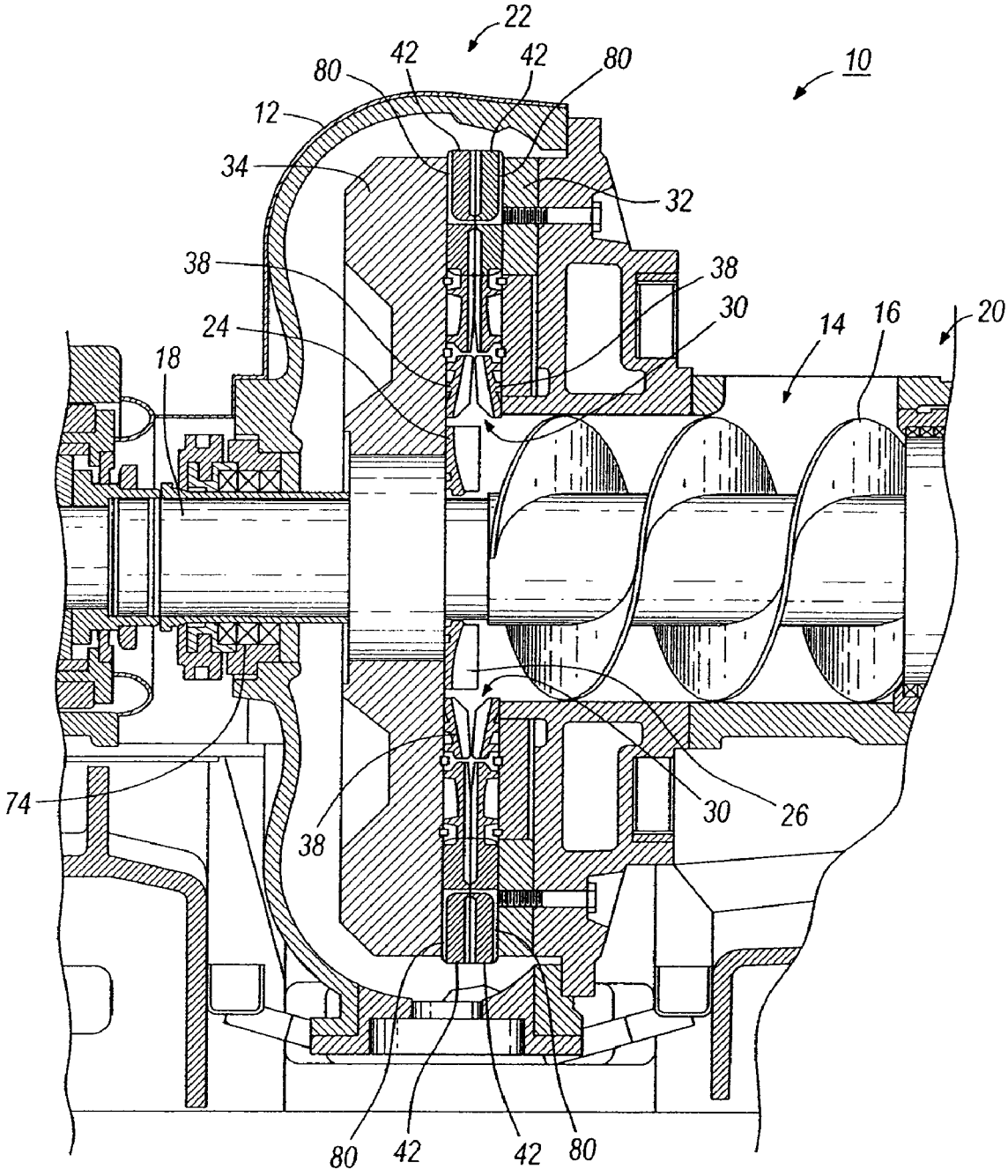
FIG. 1 is an enlarged sectional view of a portion of a rotary refiner according to an embodiment of the present invention.
Figure 2:
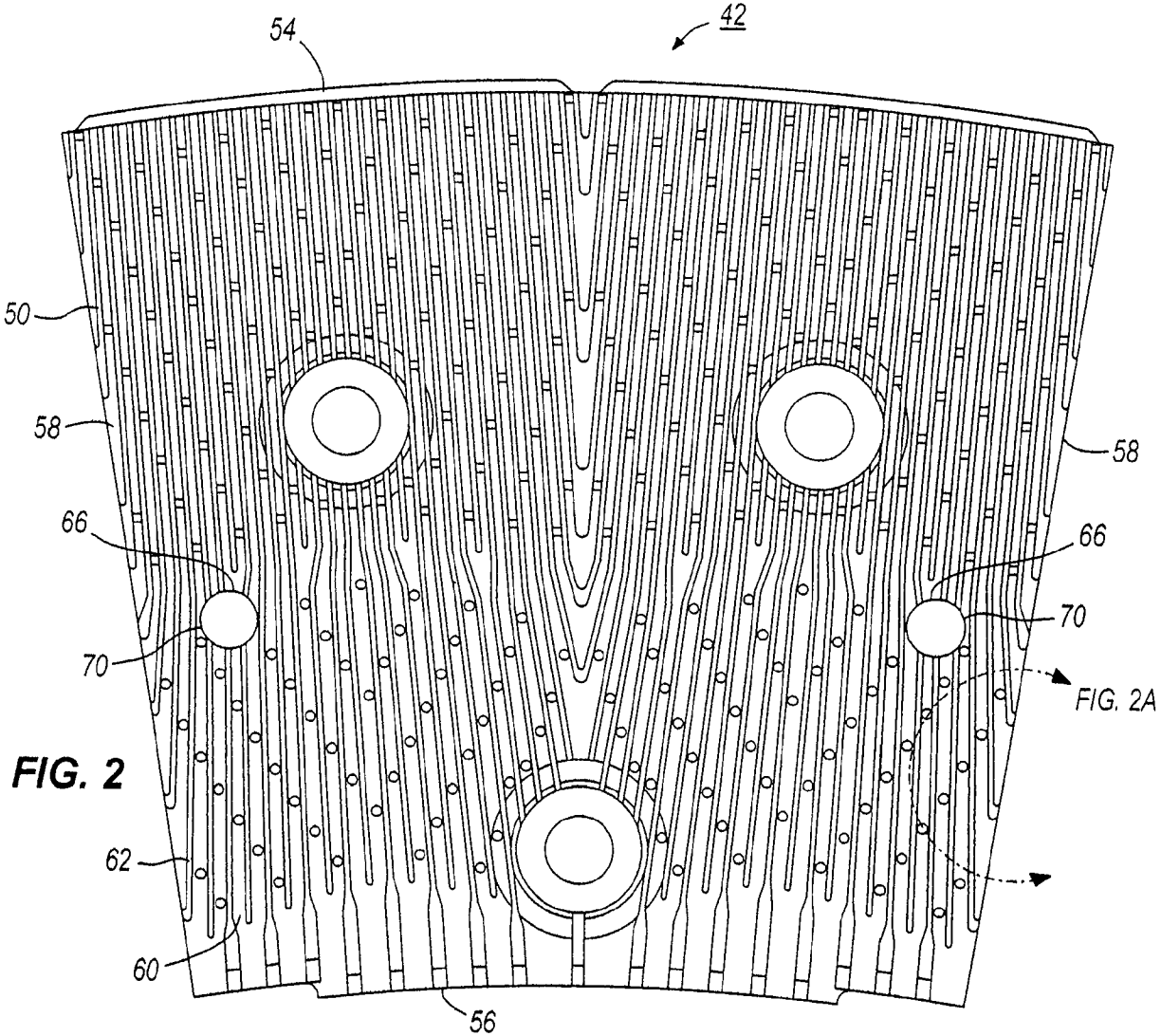
FIG. 2 is a front view of a refiner plate of the rotary refiner shown in FIG. 1.
Figure 2A:
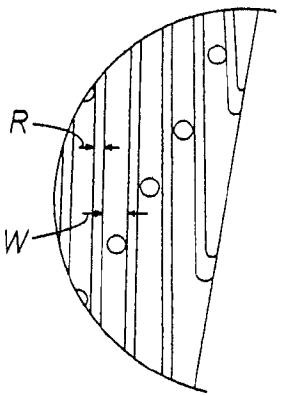
FIG. 2A is an enlarged front view of a portion of the refiner plate shown in FIG. 2.
Figure 3:
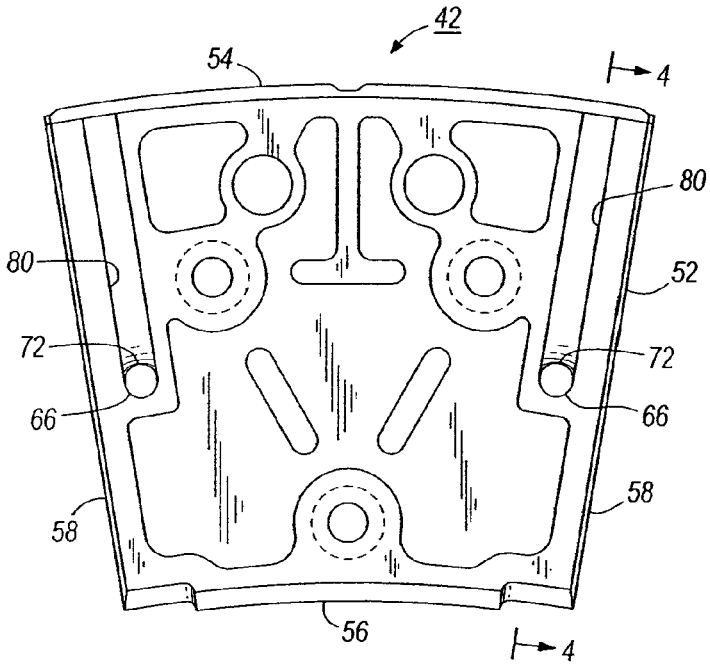
FIG. 3 is a rear view of the refiner plate shown in FIG. 2.
Figure 4:
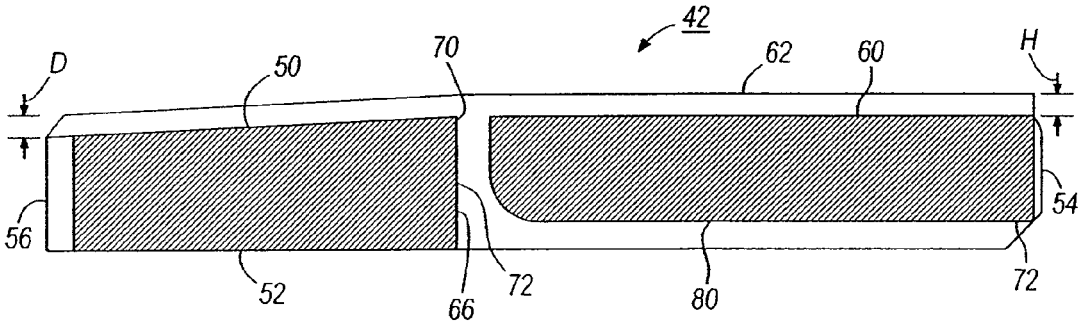
FIG. 4 is an enlarged cross sectional view of the refiner plate taken along line 4-4.
Figure 5:
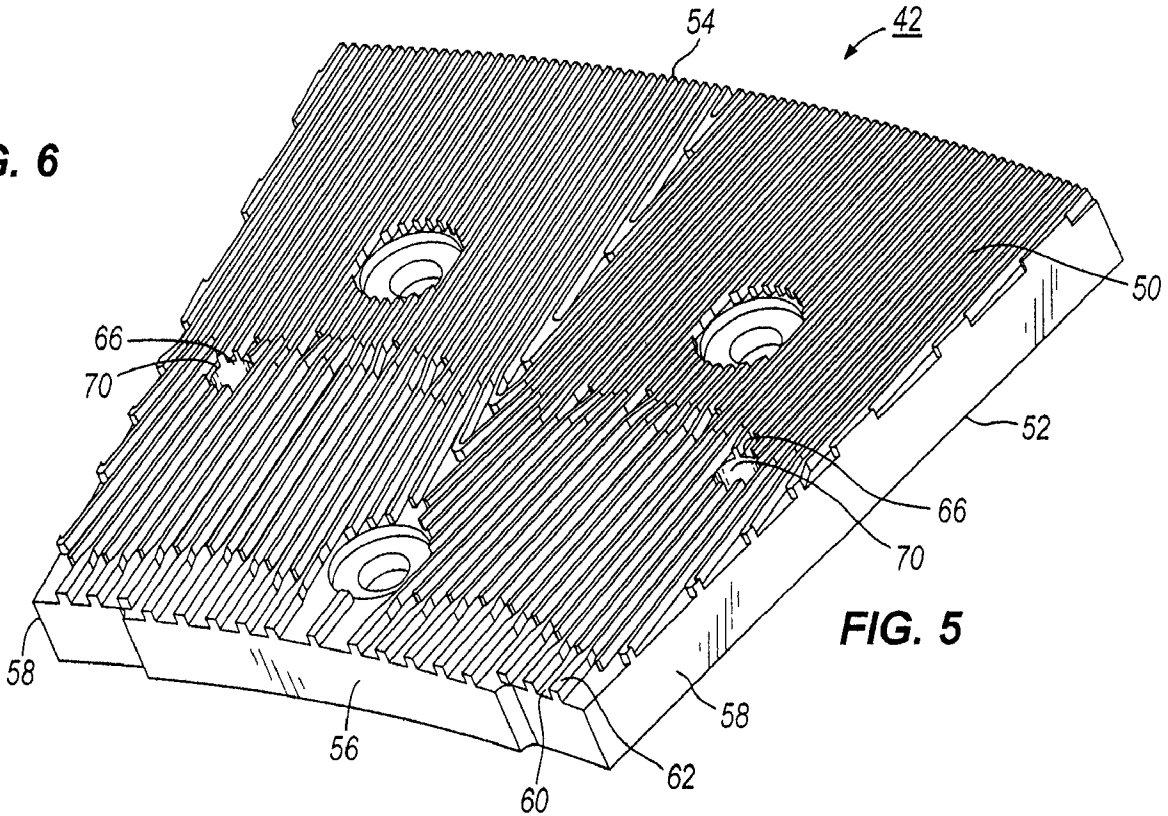
FIG. 5 is a perspective view of the rotary refiner plate shown in FIG. 2.

Before the various embodiments of the present invention are explained in detail, it is to be understood that the invention is not limited in its application to the details of construction and the arrangements of components set forth in the following description or illustrated in the drawings. The invention is capable of other embodiments and of being practiced or of being carried out in various ways. Also, it is to be understood that phraseology and terminology used herein with reference to device or element orientation (such as, for example, terms like "front", "rear", "up", "down", "inner", "outer", and the like) are only used to simplify description of the present invention, and do not alone indicate or imply that the device or element referred to must have a particular orientation. The rotary refiner and elements of the rotary refiner referred to in the present invention can be installed and operated in any orientation desired. In addition, terms such as "first" and "second" are used herein and in the appended claims for purposes of description and are not intended to indicate or imply relative importance or significance.

DETAILED DESCRIPTION

Figure 6:
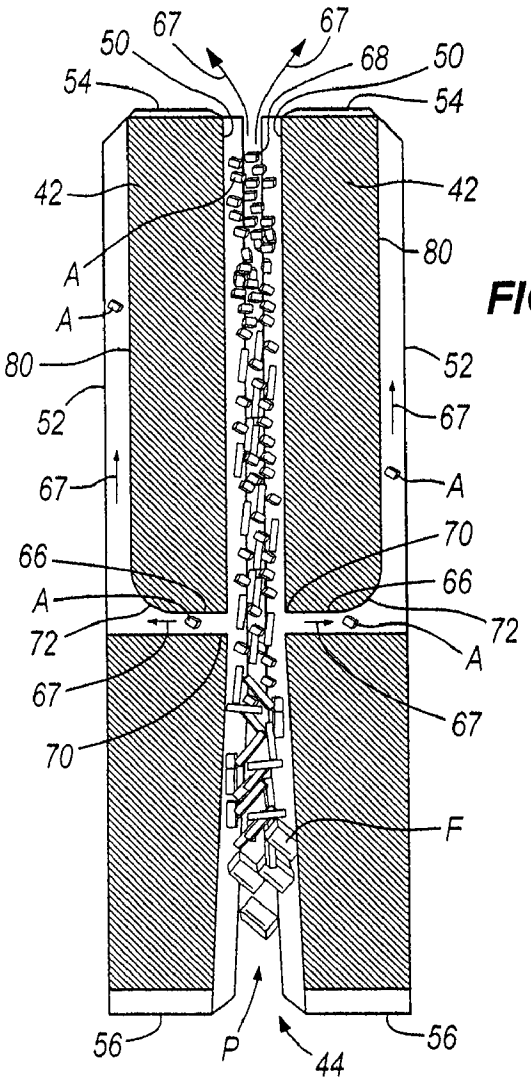
FIG. 6 is an enlarged sectional view of the rotary refiner shown in FIG. 1 and illustrating pulp flow through the rotary refiner.

FIG. 1 illustrates a portion of a rotary refiner 10 according to some embodiments of the present invention. As explained in greater detail below, the rotary refiner 10 is operable to refine or treat pulp P (shown in FIG. 6) for use in paper products, paper-related products, and other fiber-based products. In some embodiments, the pulp P can include a liquid slurry and fibers (e.g., wood chips, wood fibers, cotton, cloth, and the like) F suspended in the slurry.

As shown in FIG. 1, the rotary refiner 10 can include a housing 12 and a feed system 14 supported in the housing 12 for moving pulp P through the refiner 10. In the illustrated embodiment of FIG. 1, the feed system 14 includes an auger 16 and a drive shaft 18 extending through the housing 12. In these embodiments, the drive shaft 18 rotates the auger 16 relative to the housing 12 about the axis of the drive shaft 18 to move pulp P between an inlet side 20 of the housing 12 and an outlet side 22 of the housing 12. In other embodiments, other feed systems 14, including ducts, vacuum pumps, and the like can also or alternately be used to move pulp P through the housing 12.

In the illustrated embodiment of FIG. 1, the feed system 14 also includes a flinger nut 24, which is connected to the drive shaft 18 for rotation with the drive shaft 18 about the drive shaft axis. The flinger nut 24 of the illustrated embodiment includes outwardly extending wings 26, which operate to direct at least some of the pulp P radially outwardly from the auger 16 toward one or more refining zones 30.

As shown in FIG. 1, the refiner 10 includes a single refining zone 30, which is positioned adjacent to a downstream end of the feed system 14 and extends circumferentially around the drive shaft 18. In other embodiments, the refiner 10 can include two or more refining zones 30, which can be positioned above, below, or to one side of the feed system 14 or which can be axially aligned with the feed system 14. In addition, the refiner 10 can include two or more feed systems 14 for directing pulp P toward a single refining zone 30, or alternately, for directing pulp P toward two or more refining zones 30.

In the illustrated embodiment of FIG. 1, the feed system 14 controls and regulates the flow of pulp P into the refining zone 30. In some embodiments, the rotational speed of the drive shaft 18 can be increased or decreased to increase or decrease the flow of pulp P into the refining zone 30. Alternatively or in addition, the refiner 10 can include control valves for controlling the flow of pulp P into the refining zone 30 and for controlling the flow of processed pulp material or accepts A out of the refining zone 30. In these embodiments, inlet valves can be positioned on an inlet or upstream side of the refining zone 30 and outlet valves can be located on an outlet or downstream side of the refining zone 30.

In some embodiments, the inlet valves can operate as one-way valves and can prevent or limit the flow of pulp P out of the refining zone 30 back toward the feed system 14. In addition, the outlet valves can operate as one-way valves and can prevent or limit the flow of accepts A or exhaust into the refining zone 30.

As shown in FIG. 1, the refiner 10 can also include first and second mounting plates 32, 34, which at least partially surround the refining zone 30. In the illustrated embodiment, the first mounting plate 32 is secured to the housing 12 and the second mounting plate 34 is connected to the drive shaft 18 for rotation with the drive shaft 18 about the drive shaft axis. In other embodiments, both of the first and second mounting plates 32, 34 can be supported for rotational movement. In some such embodiments, the first and second mounting plates 32, 34 can be rotated in opposite rotational directions.

In the illustrated embodiment of FIG. 1, the refiner 10 includes breaker bars 38, which extend circumferentially around interior portions of the first and second mounting plates 32, 34. In these embodiments, the breaker bars 38 are operable to treat or refine pulp P as the pulp P enters the refining zone 30 and to break relatively large fibers F into smaller pieces before the pulp P moves radially outwardly for additional refining.

As shown in FIG. 1, the refiner 10 also includes refiner plates 42, which extend through the refining zone 30. In the illustrated embodiment of FIGS. 1-5, a number of refiner plates 42 are arranged circumferentially around opposite sides of the first and second mounting surfaces 32, 34 and are spaced apart to define a refiner gap 44 (shown in FIG. 6). In the illustrated embodiment, the refiner plates 42 secured to the second mounting plate 34 are rotatable with the second mounting plate 34 about the drive shaft axis.

As shown in FIGS. 2-5, the refiner plates 42 have a first or front side 50, a second or rear side 52, an outer edge 54, an inner edge 56, and side walls 58 extending between the front and rear sides 50, 52. In the illustrated embodiment of FIGS. 2-5, a number of grooves 60 are formed in the front side 50 of the refiner plates 42. The refiner plates 42 also include a number of outwardly extending ridges 62, which are positioned between the grooves 60. In the illustrated embodiment, the grooves 60 and the ridges 62 extend in a generally linear direction between the inner and outer edges 56, 54. In other embodiments, the grooves 60 and the ridges 62 can have other orientations and configurations. For example, in some embodiments, at least some of the grooves 60 and at least some of the ridges 62 extend in a generally linear direction between the side walls 58. In other embodiments, at least some of the grooves 60 and at least some of the ridges 62 are angled or inclined with respect to the side walls 58 of the refiner plates 42. In still other embodiments, at least some of the grooves 60 and at least some of the ridges 62 extend along the front side 50 of the refiner plates 42 in a generally arcuate direction.

In some embodiments, the refiner plates 42 can be forged and can include grooves 60 and/or ridges 62 formed to have the desired dimensions and desired orientations. In some embodiments, such as the illustrated embodiment of FIGS. 2-5, the grooves 60 and the ridges 62 are relatively small and are positioned in relatively close proximity. In these embodiments, the grooves 60 and the ridges 62 of the refiner plates 42 can be formed using electrical discharge machining, such as, for example, die-sinking electrical discharge machining, wire electrical discharge machining, electrical discharge milling, and the like. In these embodiments, the dimensions and locations of the grooves 60 and the ridges 62 can be closely controlled and can be made much smaller than by some other methods and apparatuses (e.g., casting). In other embodiments, the grooves 60 and/or the ridges 62 can be formed using alternate methods and apparatuses, such as, for example, milling, drilling, computer numerical control machining, waterjets, and the like.

As explained in greater detail below, the size and location of the grooves 60 and the ridges 62 can vary depending on a number of factors, such as, for example, the composition of the pulp P, the extent to which the pulp P is intended to be refined (i.e., the desired size and the intended use of the accepts A), the spacing between refiner plates 42 (i.e., the refiner gap 44), and the temperature of the refining zone 30 during refining. However, it has been discovered that relatively low processing times can be achieved and accepts A having a relatively high quality can be formed using refiner plates 42 including grooves 60 having a depth D of between about 0.3 millimeters and about 10.0 millimeters. Refiner plates 42 including grooves 60 having a depth D of between about 2.0 millimeters and about 5.0 millimeters achieve still lower processing times and form accepts A having higher quality. Refiner plates 42 including grooves 60 having a depth D of between about 2.5 millimeters and about 4.0 millimeters achieve the lowest processing times and form accepts A having the highest quality.

In addition, relatively low processing times can be achieved and accepts A having a relatively high quality can be formed using refiner plates 42 including grooves 60 having a width W of between about 0.5 millimeters and about 5.0 millimeters. Refiner plates 42 including grooves 60 having a width W of between about 1.5 millimeters and about 4.0 millimeters have achieved still lower processing times and form accepts A having higher quality. Refiner plates 42 including grooves 60 having a width W of between about 2.0 millimeters and about 3.0 millimeters achieve the lowest processing times and form accepts A having the highest quality.

In addition, relatively low processing times can be achieved and accepts A having a relatively high quality can be formed using refiner plates 42 including ridges 62 having a width R of between about 1.0 millimeter and about 4.0 millimeters and having a height H of between about 0.3 millimeters and about 10.0 millimeters. Still lower processing times can be achieved and accepts A having still higher quality can be formed using refiner plates 42 including ridges 62 having a width R of between about 1.5 millimeters and about 3.5 millimeters and having a height H of between about 2.0 millimeters and about 5.0 millimeters. The best processing times can be achieved and accepts A having the highest quality can be formed using refiner plates 42 including ridges 62 having a width R of between about 2.0 millimeters and about 3.0 millimeters and having a height H of between about 2.5 millimeters and about 4.0 millimeters.

As shown in FIGS. 2-5, the refiner plates 42 can include channels 66, which are operable to direct accepts A and/or exhaust vapor (represented by arrow 67 in FIG. 6) from the front 50 of the refiner plates 42 outwardly and away from the refiner plates 42. In the illustrated embodiment, each of the refiner plates 42 includes two channels 66 extending between channel inlets 70 defined in the front side 50 of the refiner plates 42 and channel outlets 72 defined in the rear sides 50 of the refiner plates 42. In other embodiments, the refiner plates 42 can include one, three or more channels 66, each of which can include one or more inlets 70 and one or more outlets 72. In still other embodiments, the channels 66 can extend between inlets 70 located on the front sides 50 of the refiner plates 42 and outlets 72 defined in the side walls 58 of the refiner plates 42.

In the illustrated embodiment of FIGS. 2-5, the inlets 70 are generally circular and have a diameter of between about 18 millimeters and about 1 millimeter. In other embodiments, the inlets 70 can have any shape desired, such as a rectangular, triangular, or other polygonal shape, an irregular shape, and the like.

In some embodiments, such as the illustrated embodiment of FIGS. 2-5, screens or filters can be positioned in the channels 66. In these embodiments, the screens and the openings in the screens are sized to allow accepts A and exhaust vapor 67 to enter the channels 66, while preventing at least some of the unrefined fibers F from entering the channels 66. In other embodiments, the channel inlets 70 are positioned radially outwardly toward the outer edge 50 to prevent unrefined fibers F from entering the channels 66.

In operation, the feed system 14 directs pulp P axially through the housing 12 from the inlet side 20 of the housing 12 toward the refining zone 30. Once in the refining zone 30, the pulp P is directed radially outwardly across the breaker bars 38 where at least some of the fibers F are partially fibrillated or partially refined.

From the breaker bars 38, the pulp P continues to move outwardly through the refiner gap 44 where the fibers F are sheared between the refiner plates 42 as the second mounting plate 34 and the refiner plates 42 secured to the second mounting plate 34 rotate with respect to the first mounting plate 32 and the refiner plates 42 secured to the first mounting plate 32.

More specifically, as the pulp P moves radially outwardly through the refiner gap 44, the fibers F are refined or fibrillated between opposing ridges 62 to form accepts A. In embodiments such as the illustrated embodiment of FIGS. 2-5 in which the refiner plates 42 include relatively shallow grooves 60 and relatively small ridges 62, individual fibers F are exposed to a maximum number of ridges 62 and are prevented from accumulating in the relatively shallow grooves 60. In this manner, higher volumes of pulp P can be processed in shorter time periods.

During operation of the rotary refiner 10, the rotational movement of the second mounting plate 32 and the refiner plates 42 secured to the second mounting plate 32 can generate heat, which causes at least some of the slurry to vaporize. In some embodiments, coolant is supplied to the refining zone 30 to lubricate the refiner plates 42, cool the refiner plates 42, and/or dilute the pulp material P supplied to the refining zone 30. In other embodiments, the refiners 42 can be air-cooled. In embodiments in which coolant is supplied to the refining zone 30, at least some of the coolant can be vaporized.

As the slurry and/or the coolant is vaporized, at least some of the exhaust vapor (represented by arrows 67 in FIG. 6) enters the channels 66 and is directed into the channel inlets 70 and through the channels 66 toward the rear side 52 of the refiner plates 42. The exhaust vapor 67 can then be directed along the rear sides 52 of the refiner plates 42 and outwardly away from the refiner zone 30. In some embodiments, the exhaust vapor 67 is directed radially outwardly from the channel outlets 72 along the rear side 52 of the refiner plates 42 or radially outwardly through ducts or channels 80 defined between the rear sides 52 of the refiner plates 42 and the mounting plates 32, 34.

As the exhaust vapor 67 is vented from the refining zone 30, the pressure in the refining zone 30 is reduced and/or prevented from increasing above a maximums allowable level, thereby allowing a relatively high mass flow rate of pulp P through the refining zone 30. In addition, the reduction in pressure in the refining zone 30 reduces the load applied to the drive shaft 18 and the bearings 74 supporting the drive shaft 18. This reduction in the load applied to the drive shaft 18 and the bearings 74 can increase the operational life of the refiner 10 and can reduce the wear experienced by the feed system 14 and the bearings 74.

In some embodiments, the flow of exhaust vapor 67 through the refining zone 30 can be controlled to reduce recirculation of exhaust vapor 67, accepts A, and/or pulp material P through the refining zone 30 and to prevent or reduce counter flow of exhaust vapor 67, accepts A, and/or pulp material P through the refining zone 30. In the illustrated embodiment of FIGS. 1-6, the size of the inlets 70 is closely controlled to regulate the pressure in the refining zone 30. In these embodiments, exhaust vapor 67 and accepts A are vented from the refining zone 30 to maintain the pressure in the refining zone 30 at a relatively low value so that exhaust vapor 67, accepts A, and/or pulp material P travel in a generally linear outward direction between the inner and outer edges 56, 54 of the refiner plates 42.

Accepts A formed adjacent to the inner edges 56 of the refiner plates 42 can be drawn into the channel inlets 70 and can be exhausted from the refiner gap 44 along with the exhaust vapor 67 through the channels 66 and through the channels or ducts 80 formed between the refiner plates 42 and the mounting plates 32, 34. The accepts A and the exhaust vapor 67 can then be separated and collected at a downstream location.

In some embodiments, the pressure of exhaust vapor 67 in the refining zone 30 can be controlled to reduce re-circulation of exhaust vapor 67 and/or accepts A through the refining zone 30 and to reduce or prevent the counter-flow of slurry and exhaust vapor 67. In the illustrated embodiment of FIGS. 1-6, the size of the inlets 70 is closely controlled to regulate the pressure in the refining zone 30. In these embodiments, the pressure adjacent to the outer edges 54 of the refiner plates 42 is generally greater than the pressure at the inner edges 56 of the refiner plates 42, or alternatively, at an interior portion of the refiner plates 42 between the outer and inner edges 54, 56. In other embodiments, the pressure adjacent to the inner edges 56 of the refiner plates 42 is generally greater than the pressure at the outer edges 54 of the refiner plates 42, or alternatively, at an interior portion of the refiner plates 42 between the outer and inner edges 54, 56.

Because at least some of the accepts A exit the refining zone 30 through the channels 66 and do not travel across the refiner plates 30 the entire distance between the inner and outer edges 56, 54, unnecessary refining operations are not performed on these accepts A after these accepts A have been refined to a desired size. In this manner, energy is not required to over-refine these accepts A and the energy required to refine a given volume of pulp P can be minimized.

The size and mass of the larger unrefined fibers F prevents the exhaust vapor 67 from carrying the unrefined fibers F outwardly through the channels 66 so that the larger fibers F remain in the refining zone 30 until the larger fibers F are properly refined. These fibers F continue to travel outwardly across the refiner plates 42 from the inner edges 56 of the refiner plates 42 toward the outer edges 54 of the refiner plates 42 and are thereby refined to form accepts A. These accepts A are then directed outwardly away from the refiner plates 42 and are collected at a downstream location.

In some embodiments, at least some of the exhaust vapor 67 does not exit the refiner gap 44 through the channels 66. In these embodiments, at least some of the exhaust vapor 67 travels outwardly across the front sides 50 of the refiner plates 42 toward the outer edges 54 of the refiner plates 42. From the outer edges 54, the exhaust vapor 67 is directed toward a downstream location and can be collected for reuse.

Various alternatives and embodiments are contemplated as being within the scope of the following claims particularly pointing out and distinctly claiming the subject matter regarded as the invention.

What is claimed is:

1. A refiner plate for a refiner for forming accepts and exhaust from a pulp material, the refiner plate comprising:

a refining side extending between inner, outer, and side peripheral walls; and a channel having an inlet passage opening at the refining side and extending transversely through a portion of the refiner plate in the direction away from the refining side, an outlet passage extending from the inlet passage through another portion of the refiner plate in the direction from the inner peripheral wall to the outer peripheral wall, and an outlet located at the outer peripheral wall of the refiner plate and opening to the outlet passage, the refiner plate defining at least one side wall and an inner end wall of the outlet passage;

wherein the inner end wall is disposed between the inlet passage of the channel and the inner peripheral wall and defines a blocking surface that physically obstructs accepts entering the inlet passage opening from passing to a pulp feed area of the refiner such that the accepts flow radially outward within the outlet passage to the outlet so as to direct the accepts within the outlet passage away from the refining side of the refiner plate.

2. The refiner plate of claim 1, wherein the refining side includes a plurality of outwardly extending ridges.

3. The refiner plate of claim 2, wherein at least some of the plurality of outwardly extending ridges are spaced between about 0.5 millimeters and about 5 millimeters apart.

4. The refiner plate of claim 2, wherein at least some of the ridges have a height of between about 0.3 millimeters and about 10 millimeters.

5. The refiner plate of claim 1, wherein the refining side defines a plurality of grooves.

6. The refiner plate of claim 5, wherein at least some of the plurality of grooves are spaced between about 1 millimeter and about 4 millimeters apart.

7. The refiner plate of claim 5, wherein at least one of the plurality of grooves has a depth of between about 0.3 and about 10 millimeters.

8. The refiner plate of claim 1, wherein the outlet passage of the channel extends along a second side of the refiner plate spaced from the refining side.

9. The refiner plate of claim 1, wherein the inlet passage includes a generally circular inlet that has a diameter of between about 1 millimeter and about 18 millimeters.

10. The refiner plate of claim 1, wherein at least some exhaust and at least some accepts are directed across the refining side beyond the outer peripheral wall.

11. The refiner plate of claim 8, wherein at least some exhaust and at least some accepts are directed across the second side beyond the outer peripheral wall.

12. A refiner plate for a refiner for forming accepts and exhaust from a pulp material, the refiner plate comprising:

a refining side extending between inner, outer, and side peripheral walls; and a channel having an inlet passage opening to the refining side and extending through a portion of the refiner plate in the direction away from the refining side, an outlet passage extending from the inlet passage through another portion of the refiner plate in the direction from the inner peripheral wall to the outer peripheral wall, and an outlet located at one of the outer peripheral wall and the side peripheral wall of the refiner plate and opening to the outlet passage, the refiner plate defining opposite side walls and an inner end wall of the outlet passage;

wherein the inner end wall is disposed between the inlet passage of the channel and the inner peripheral wall and defines a blocking surface that physically obstructs accepts entering the inlet passage opening from passing to a pulp feed area of the refiner such that the accepts flow radially outward within the outlet passage to the outlet so as to direct the accepts within the outlet passage away from the refining side of the refiner plate.

13. The refiner plate of claim 12, wherein the outlet passage of the channel extends along a second side spaced from the refining side.

14. The refiner plate of claim 12, further comprising a plurality of ridges extending across at least a portion of the refining side.

15. The refiner plate of claim 14, wherein the plurality of ridges are spaced less than about 5 millimeters apart.

16. The refiner plate of claim 14, wherein the ridges have a height of less than about 10 millimeters.

17. The refiner plate of claim 14, wherein the refining side defines a plurality of grooves.

18. The refiner plate of claim 15, wherein the plurality of grooves are spaced less than about 4 millimeters apart.

19. The refiner plate of claim 15, wherein at least one of the plurality of grooves has a depth of less than about 10 millimeters.

20. The refiner plate of claim 12, wherein the inlet passage includes a generally circular inlet that has a diameter of between about 1 millimeter and about 18 millimeters.

21. The refiner plate of claim 12, wherein at least some exhaust and at least some accepts are directed across the refining side beyond the outer peripheral wall.

22. The refiner plate of claim 13, wherein at least some exhaust and at least some accepts are directed across the second side beyond the outer peripheral wall before being directed away from the refiner plate.

23. The refiner plate of claim 12, wherein the outlet is located at the side peripheral wall.

* * * * *